US008681076B2

(12) United States Patent
Lee et al.

(10) Patent No.: US 8,681,076 B2
(45) Date of Patent: Mar. 25, 2014

(54) PLASMA DISPLAY PANEL

(75) Inventors: Euntae Lee, Cheongju-si (KR); Byunghwa Seo, Cheongju-si (KR)

(73) Assignee: LG Electronics Inc., Seoul (KR)

( * ) Notice: Subject to any disclaimer, the term of this patent is extended or adjusted under 35 U.S.C. 154(b) by 1197 days.

(21) Appl. No.: 12/595,053

(22) PCT Filed: Apr. 8, 2008

(86) PCT No.: PCT/KR2008/001990

§ 371 (c)(1),
(2), (4) Date: Oct. 8, 2009

(87) PCT Pub. No.: WO2008/123743

PCT Pub. Date: Oct. 16, 2008

(65) Prior Publication Data

US 2010/0134386 A1 Jun. 3, 2010

(30) Foreign Application Priority Data

Apr. 9, 2007 (KR) ..... 10-2007-0034797

(51) Int. Cl.
*G09G 3/28* (2013.01)
*H01J 17/49* (2012.01)

(52) U.S. Cl.
USPC ..... 345/60; 345/67; 313/566; 315/169.4

(58) Field of Classification Search
USPC ..... 345/37, 41, 55, 60–72; 313/567, 313/581–587; 315/169.4
See application file for complete search history.

(56) References Cited

U.S. PATENT DOCUMENTS

| | | | | |
|---|---|---|---|---|
| 2005/0099126 | A1* | 5/2005 | Kim et al. | 313/586 |
| 2006/0125398 | A1* | 6/2006 | Ahn | 313/583 |
| 2006/0152159 | A1* | 7/2006 | Yoo | 313/587 |

FOREIGN PATENT DOCUMENTS

| | | |
|---|---|---|
| JP | 10-283934 | 10/1998 |
| JP | 11-297209 | 10/1999 |
| JP | 2001-216904 | 8/2001 |
| JP | 2003-217454 | 7/2003 |
| JP | 2003-234069 | 8/2003 |
| JP | 2005-019006 | 1/2005 |
| JP | 2005-174851 | 6/2005 |

OTHER PUBLICATIONS

Korean Office Action dated Jan. 21, 2008.
International Search Report dated Aug. 20, 2008.

* cited by examiner

*Primary Examiner* — Lun-Yi Lao
*Assistant Examiner* — Jarurat Suteerawongsa
(74) *Attorney, Agent, or Firm* — KED & Associates LLP

(57) ABSTRACT

The present invention relates to a plasma display panel including a front substrate, a plurality of electrodes arranged on the front substrate, an upper dielectric layer covering the plurality of electrodes on the front substrate, and a rear substrate arranged opposite to the front substrate, wherein the upper dielectric layer comprises a convex portion thicker than a surrounding portion thereof and a concave portion thinner than a surrounding portion thereof, and the thickness of the portion of the upper dielectric layer corresponding to the concave portion is equal to or more than 0.04 times and equal to or less than 0.9 times of the thickness of the portion of the upper dielectric layer corresponding to the convex portion.

9 Claims, 9 Drawing Sheets

Fig. 5

| $t_1/t_2$ | Discharge firing voltage | Degree of difficulty of process | Structural stability |
|---|---|---|---|
| 0.03 | ◎ | X | X |
| 0.04 | ◎ | ○ | ○ |
| 0.045 | ◎ | ○ | ○ |
| 0.06 | ◎ | ○ | ○ |
| 0.092 | ◎ | ○ | ◎ |
| 0.12 | ◎ | ○ | ◎ |
| 0.15 | ◎ | ◎ | ◎ |
| 0.3 | ◎ | ◎ | ◎ |
| 0.5 | ◎ | ◎ | ◎ |
| 0.63 | ◎ | ◎ | ◎ |
| 0.7 | ◎ | ◎ | ◎ |
| 0.85 | ○ | ◎ | ◎ |
| 0.9 | ○ | ◎ | ◎ |
| 0.98 | X | ◎ | ◎ |

Fig. 6

| $W_1/W_2$ | Structural stability | Discharge firing voltage |
|---|---|---|
| 0.01 | ◎ | X |
| 0.019 | ◎ | X |
| 0.03 | ◎ | ○ |
| 0.05 | ◎ | ○ |
| 0.12 | ◎ | ○ |
| 0.14 | ◎ | ◎ |
| 0.43 | ◎ | ◎ |
| 0.57 | ◎ | ◎ |
| 0.69 | ◎ | ◎ |
| 0.72 | ◎ | ◎ |
| 0.83 | ○ | ◎ |
| 0.87 | ○ | ◎ |
| 0.95 | X | ◎ |

Fig. 7

| $d_2/d_1$ | Dielectric breakdown | Driving efficiency |
|---|---|---|
| 1.05 | X | ◎ |
| 1.1 | ○ | ◎ |
| 1.2 | ○ | ◎ |
| 1.28 | ○ | ◎ |
| 1.32 | ◎ | ◎ |
| 2.1 | ◎ | ◎ |
| 3.51 | ◎ | ◎ |
| 4.25 | ◎ | ◎ |
| 5.3 | ◎ | ◎ |
| 6.8 | ◎ | ○ |
| 9.5 | ◎ | ○ |
| 13.5 | ◎ | ○ |
| 17.2 | ◎ | ○ |
| 20.3 | ◎ | ○ |
| 24 | ◎ | ○ |
| 27 | ◎ | X |

| θ | Discharge firing voltage | Structural stability |
|---|---|---|
| 2 | X | ◎ |
| 3 | X | ◎ |
| 7 | X | ◎ |
| 10 | ○ | ◎ |
| 15 | ◎ | ◎ |
| 20 | ◎ | ◎ |
| 30 | ◎ | ◎ |
| 50 | ◎ | ◎ |
| 60 | ◎ | ◎ |
| 70 | ◎ | ○ |
| 80 | ◎ | ○ |
| 90 | ◎ | X |

PLASMA DISPLAY PANEL

TECHNICAL FIELD

The present invention relates to a plasma display panel.

BACKGROUND ART

In general, a plasma display panel includes a phosphor layer formed in discharge cells partitioned by a barrier rib and a plurality of electrodes. A driving signal is provided to the discharge cells through the electrodes. Then, discharge occurs in the discharge cells according to the driving signal. Here, discharge gas filled in the discharge cells generates vacuum ultraviolet rays and the generated vacuum ultraviolet rays excite the phosphor material of the phosphor layer formed in the discharge cells to generate visible rays. An image is displayed on the screen of the plasma display panel according to the visible rays.

DISCLOSURE OF INVENTION

Technical Problem

An object of the present invention is to provide a plasma display panel for improving the structure of an upper dielectric layer to enhance driving efficiency.

Technical Solution

According to an aspect of the present invention, there is provided a plasma display panel comprising: a front substrate; a plurality of electrodes arranged on the front substrate; an upper dielectric layer covering the plurality of electrodes on the front substrate; and a rear substrate arranged opposite to the front substrate, wherein the upper dielectric layer comprises a convex portion thicker than the surrounding portion and a concave portion thinner than the surrounding portion, and the thickness of the portion of the upper dielectric layer corresponding to the concave portion is equal to or more than 0.04 times and equal to or less than 0.9 times of the thickness of the portion of the upper dielectric layer corresponding to the convex portion.

The thickness of the portion of the upper dielectric layer corresponding to the concave portion is equal to or more than 0.15 times and equal to or less than 0.7 times of the thickness of the portion of the upper dielectric layer corresponding to the convex portion.

The electrodes comprise a scan electrode and a sustain electrode, and the concave portion is located between the scan electrode and the sustain electrode.

The scan electrodes and the sustain electrodes are arranged in the order of the scan electrode, the scan electrode, the sustain electrode and the sustain electrode, and the two scan electrodes or the two sustain electrodes are overlapped with the single convex portion.

The electrodes comprise a scan electrode and a sustain electrode, and the distance between the tops of neighboring two convex portions is wider than a distance between the scan electrode and the sustain electrode.

According to another aspect of the present invention, there is provided a plasma display panel comprising: a front substrate; a plurality of electrodes arranged on the front substrate; an upper dielectric layer covering the plurality of electrodes on the front substrate; and a rear substrate arranged opposite to the front substrate, wherein the upper dielectric layer comprises a convex portion thicker than the surrounding portion and a concave portion thinner than the surrounding portion, and the bottom width of the concave portion is equal to or more than 0.03 times and equal to or less than 0.87 times of the top width of the concave portion.

The bottom width of the concave portion is equal to or more than 0.14 times and equal to or less than 0.72 times of the top width of the concave portion.

The top width of the concave portion corresponds to the width of the concave portion at the surface of the upper dielectric layer and the bottom width of the concave portion is the width at a point corresponding to ¾ of the depth of the concave portion.

The electrodes comprise a scan electrode and a sustain electrode, and the concave portion is located between the scan electrode and the sustain electrode.

The scan electrodes and the sustain electrodes are arranged in the order of the scan electrode, the scan electrode, the sustain electrode and the sustain electrode, and the two scan electrodes or the two sustain electrodes are overlapped with the single convex portion.

The electrodes comprise a scan electrode and a sustain electrode, and a distance between the tops of neighboring two convex portions is wider than a distance between the scan electrode and the sustain electrode.

According to another aspect of the present invention, there is provided a plasma display panel comprising: a front substrate; a plurality of electrodes arranged on the front substrate; an upper dielectric layer covering the plurality of electrodes on the front substrate; and a rear substrate arranged opposite to the front substrate, wherein the upper dielectric layer comprises a convex portion thicker than the surrounding portion and a concave portion thinner than the surrounding portion, and the shortest distance between the surface of the convex portion and the electrodes is equal to or more than 1.1 times and equal to or less than 24 times of the depth of the concave portion.

The shortest distance between the surface of the convex portion and the electrodes is equal to or more than 1.32 times and equal to or less than 5.3 times of the depth of the concave portion.

The electrodes comprise a scan electrode and a sustain electrode, and the concave portion is located between the scan electrode and the sustain electrode.

The scan electrodes and the sustain electrodes are arranged in the order of the scan electrode, the scan electrode, the sustain electrode and the sustain electrode, and the two scan electrodes or the two sustain electrodes are overlapped with the single convex portion.

The electrodes comprise a scan electrode and a sustain electrode, and a distance between the tops of neighboring two convex portions is wider than a distance between the scan electrode and the sustain electrode.

According to another aspect of the present invention, there is provided a plasma display panel comprising: a front substrate; a plurality of electrodes arranged on the front substrate; an upper dielectric layer covering the plurality of electrodes on the front substrate; and a rear substrate arranged opposite to the front substrate, wherein the angle of an inclined face of the concave portion is equal to or more than 10° and equal to or less than 80° on the basis of the top face of the convex portion.

The angle of an inclined face of the concave portion is equal to or more than 15° and equal to or less than 60° on the basis of the top face of the convex portion.

The electrodes comprise a scan electrode and a sustain electrode, and the concave portion is located between the scan electrode and the sustain electrode.

The scan electrodes and the sustain electrodes are arranged in the order of the scan electrode, the scan electrode, the sustain electrode and the sustain electrode, and the two scan electrodes or the two sustain electrodes are overlapped with the single convex portion.

Advantageous Effects

In the plasma display panel according to an embodiment of the present invention, the concave portion and the convex portion are formed in the upper dielectric layer to improve discharge efficiency.

BRIEF DESCRIPTION OF THE DRAWINGS

FIG. 5 is a table for explaining the thickness of a portion of the upper dielectric layer corresponding to the concave portion and the thickness of a portion of the upper dielectric layer corresponding to the convex portion;

FIG. 6 is a table for explaining the width of the concave portion;

FIG. 7 is a table for explaining the shortest distance between the scan electrode or the sustain electrode and the surface of the convex portion;

MODE FOR THE INVENTION

Figure 1:
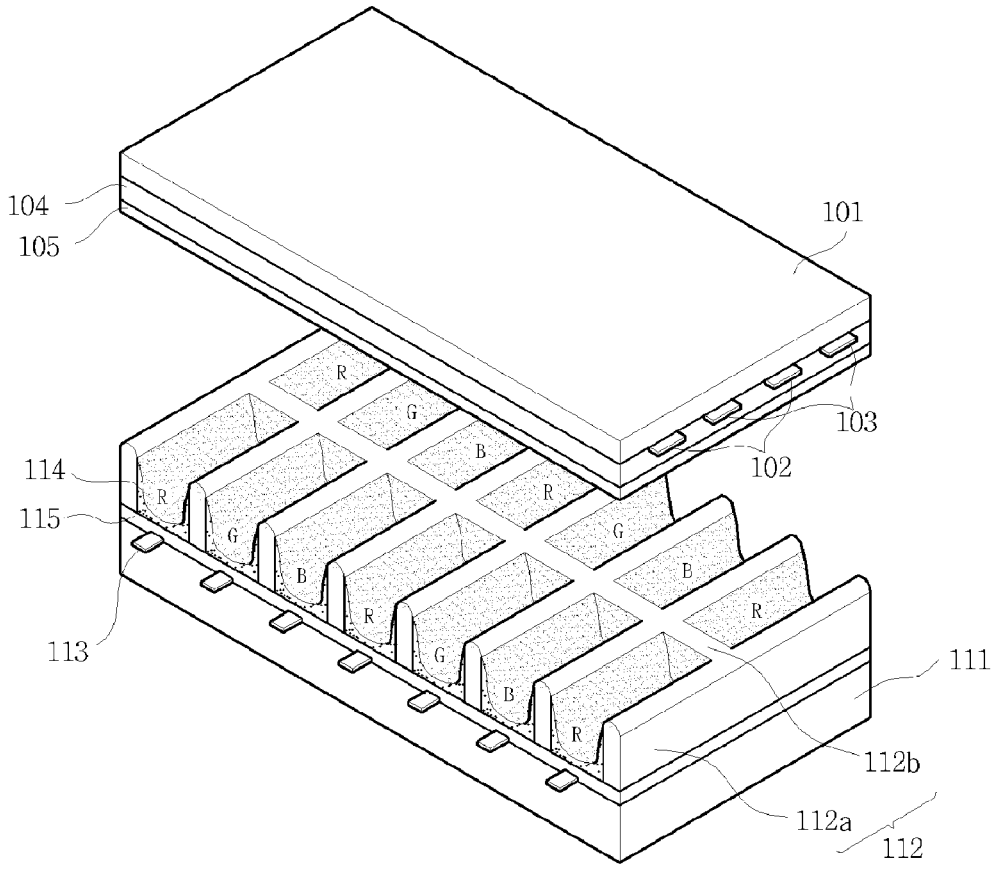
FIG. 1 illustrates a structure of a plasma display panel according to an embodiment of the present invention.

FIG. 1 illustrates a structure of a plasma display panel according to an embodiment of the present invention. Referring to FIG. 1, the plasma display panel according to an embodiment of the present invention includes a front substrate 101 on which scan electrodes 102 and sustain electrodes 103 are arranged in parallel and a rear substrate 111 on which address electrodes 113 perpendicular to the scan electrodes 102 and the sustain electrodes 103 are arranged. The front substrate 101 and the rear substrate 111 are opposite to each other and bonded to each other.

An upper dielectric layer 104 is formed on the front substrate 101 to cover the electrodes formed on the front substrate 101. For example, the upper dielectric layer 104 covering the scan electrodes 102 and the sustain electrodes 103 can be located on the front substrate 101 on which the scan electrodes 102 and the sustain electrodes 103 are arranged.

The upper dielectric layer 104 can restrict discharge currents of the scan electrodes 102 and the sustain electrodes 103 and insulate the scan electrodes 102 from the sustain electrodes 103.

A protective film 105 for facilitating a discharge condition can be located on the upper dielectric layer 104. The protective film 105 can include a material with a high secondary electron emission coefficient, for example, MgO.

Furthermore, a dielectric layer capable of covering the address electrodes 113 formed on the rear substrate 111 and insulating the address electrodes 113, for example, a lower dielectric layer 115, can be located on the rear substrate 111. A barrier rib 112 of a stripe type, a well type, a delta type or a honeycomb type, which defines discharge spaces, that is, discharge cells, can be arranged on the lower dielectric layer 115. Red discharge cells R, green discharge cells G and blue discharge cells B can be formed between the front substrate 101 and the rear substrate 111 according to the barrier rib 112. Furthermore, white discharge cells or yellow discharge cells can be included in addition to the red, green and blue discharge cells R, G and B.

In the plasma display panel according to an embodiment of the present invention, the red, green and blue discharge cells R, G and B can have the same width or at least one of the red, green and blue discharge cells R, G and B can have a width different from the width of the other discharge cells.

For example, the red discharge cells R may have the narrowest width and the green and blue discharge cells G and B may have widths greater than the width of the red discharge cells R. Here, the width of the green discharge cells G may be identical to or different from the width of the blue discharge cells B.

Then, the widths of phosphor layers formed in the discharge cells, which will be described later, depend on the widths of the discharge cells. For example, the width of a blue phosphor layer formed in a blue discharge cell B may be greater than the width of a red phosphor layer formed in a red discharge cell R and the width of a green phosphor layer formed in a green discharge cell G may be greater than the width of the red phosphor layer formed in the red discharge cell R. This can improve color temperature characteristic of images displayed on the plasma display panel.

Furthermore, the plasma display panel according to an embodiment of the present invention can have barriers in various shapes as well as the barrier rib 112 illustrated in FIG. 1. For example, the barrier rib 112 includes a first barrier rib 112*b* and a second barrier rib 112*a*. Here, the plasma display panel can have a differential barrier rib-structure in which the height of the first barrier rib 112*b* is different from the height of the second barrier rib 112*a*.

In the differential barrier rib structure, the first barrier rib 112*b* may be lower than the second barrier rib 112*a*.

Although FIG. 1 illustrates that the red, green and blue discharge cells R, G and B are arranged on the same line, the red, green and blue discharge cells R, G and B can be arranged in a different form. For example, the red, green and blue discharge cells R, G and B can be arranged in a delta form such that the red, green and blue discharge cells R, G and B are arranged in a triangle form. Furthermore, the discharge cells can have various shapes including a pentagon, a hexagon in addition to a tetragon.

Although FIG. 1 illustrates that the barrier rib 112 is formed on the rear substrate 111, the barrier rib 112 can be arranged on at least one of the front substrate 101 and the rear substrate 111.

The discharge cells partitioned by the barrier rib 112 are filled with predetermined discharge gas. In addition, phosphor layers 114 that emit visible rays for displaying images in the event of address discharge are formed in the discharge cells partitioned by the barrier rib 112. For example, red, green and blue phosphor layers can be arranged in the discharge cells.

Furthermore, at least one of a while phosphor layer or a yellow phosphor layer can be arranged in addition to the red, green and blue phosphor layers.

Moreover, the thickness of the phosphor layer 114 in at least one of the red, green and blue discharge cells R, G and B can be different from that in the other discharge cells. For example, the phosphor layer of the green discharge cell G, that is, the green phosphor layer, or the phosphor layer of the blue discharge cell B, that is, the blue phosphor layer, can be thicker than the phosphor layer of the red discharge cells R, that is, the red phosphor layer. Here, the green phosphor layer and the blue phosphor layer can be identical to or different from each other.

An example of the plasma display panel according to an embodiment of the present invention has been described and the present invention is not limited to the aforementioned plasma display panel. For example, at least one of the lower dielectric layer 115 and the upper dielectric layer 104 can be formed in a multi-layer structure although the lower dielectric layer 115 and the upper dielectric layer 104 have a single layer structure in the current embodiment, Furthermore, a black matrix (not shown) capable of absorbing external light can be arranged on the barrier rib 112 in order to prevent the external light from being reflected due to the barrier rib 112. The black matrix can be formed on a specific position on the front substrate 101, which corresponds to the barrier rib 112.

While the address electrodes 113 arranged on the rear substrate 111 can have a substantially uniform width and thickness, the width and thickness of address electrodes located in the discharge cells may be different from the width and thickness of address electrodes placed outside the discharge cells. For example, the width and thickness of address electrodes located in the discharge cells may be greater than the width and thickness of address electrodes placed outside the discharge cells.

Figure 2:
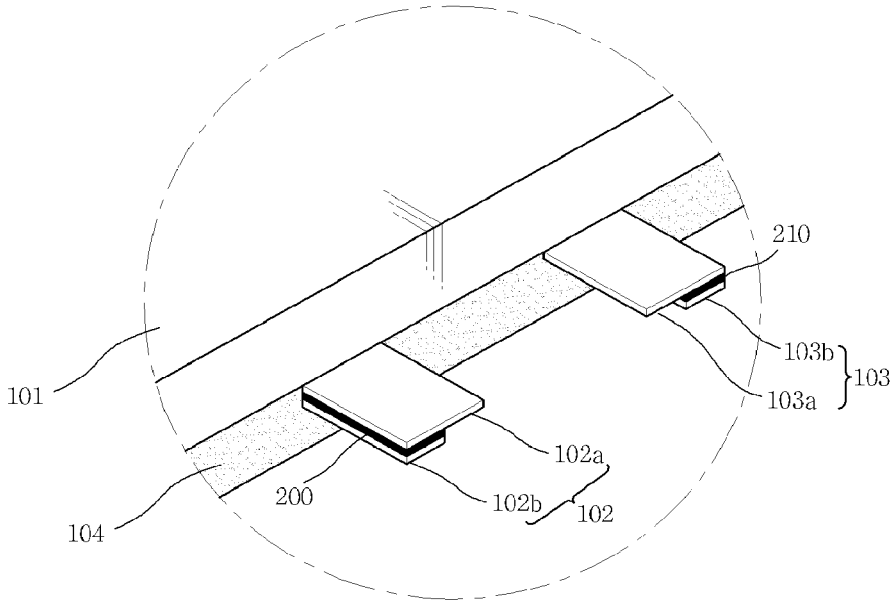
FIG. 2 is a diagram for explaining a scan electrode and a sustain electrode in more detail.

FIG. 2 is a diagram for explaining a scan electrode and a sustain electrode in more detail. Referring to FIG. 2, the scan electrode 102 and the sustain electrode 103 have a multi-layer structure. For example, the scan electrode 102 and the sustain electrode 103 can include transparent electrodes 102*a* and 103*a* and bus electrodes 102*b* and 103*b*, respectively.

The bus electrodes 102*b* and 130*b* can include a substantially opaque material, for example, Ag, Au and Al, and the transparent electrodes 102*a* and 103*a* can include a substantially transparent material, for example, ITO.

When the scan electrode 102 and the sustain electrode 103 include the bus electrodes 102*b* and 103*b* and the transparent electrodes 102*a* and 103*a*, a black layer 200 can be included between the transparent electrode 102*a* and the bus electrode 102*b* and a black layer 210 can be included between the transparent electrode 103*a* and the bus electrode 103*b* in order to prevent external light from being reflected due to the bus electrodes 102*b* and 103*b*.

It is possible to omit the transparent electrodes 102*a* and 103*a* from the scan electrode 102 and the sustain electrode 103. That is, the scan electrode 102 and the sustain electrode 103 can be ITO-less electrodes which do not include the transparent electrodes 102*a* and 103*a*.

Figure 3:
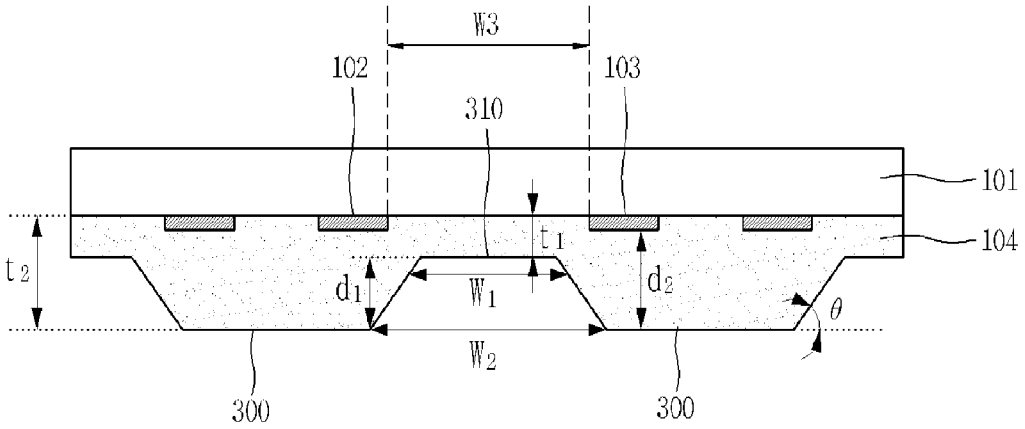
FIG. 3 is a diagram for explaining an upper dielectric layer in more detail.

FIG. 3 is a diagram for explaining the upper dielectric layer in more detail. Referring to FIG. 3, the upper dielectric layer 104 includes a convex portion 300 thicker than the surrounding portion and a concave portion 310 thinner than the surrounding portion. Here, the concave portion 310 may be located between the scan electrode 102 and the sustain electrode 103.

The thickness of the portion of the upper dielectric layer 104 corresponding to the convex portion 300 is t2 and the thickness of the portion of the upper dielectric layer 104 corresponding to the concave portion 310 is t1. The bottom width of the concave portion 310 is W1 and the top width thereof is W2. Here, it is desirable that the top width W2 of the concave portion 310 corresponds to the width of the concave portion 310 at the surface of the upper dielectric layer 104 and the bottom width W1 of the concave portion 310 is the width at a point corresponding to (¾)d1 where d1 is the depth of the concave portion 310.

It is desirable that the concave portion 310 is inclined at an angle with respect to the top face of the convex portion 300. Furthermore, it is desirable that the scan electrode 102 and the sustain electrode 103 are arranged apart from each other having a gap g between them in discharge cells.

The top width W2 of the concave portion 310 can be substantially equal to a distance between the tops of neighbouring two convex portions 300. It is desirable that the distance W2 between the tops of neighbouring two convex portions 300 is greater than a distance S3 between the scan electrode 102 and the sustain electrode 103 in order to effectively decrease a discharge voltage between the scan electrode 102 and the sustain electrode 103.

An example of functions of the convex portion 300 and the concave portion 310 are described with reference to FIG. 4.

Figure 4:
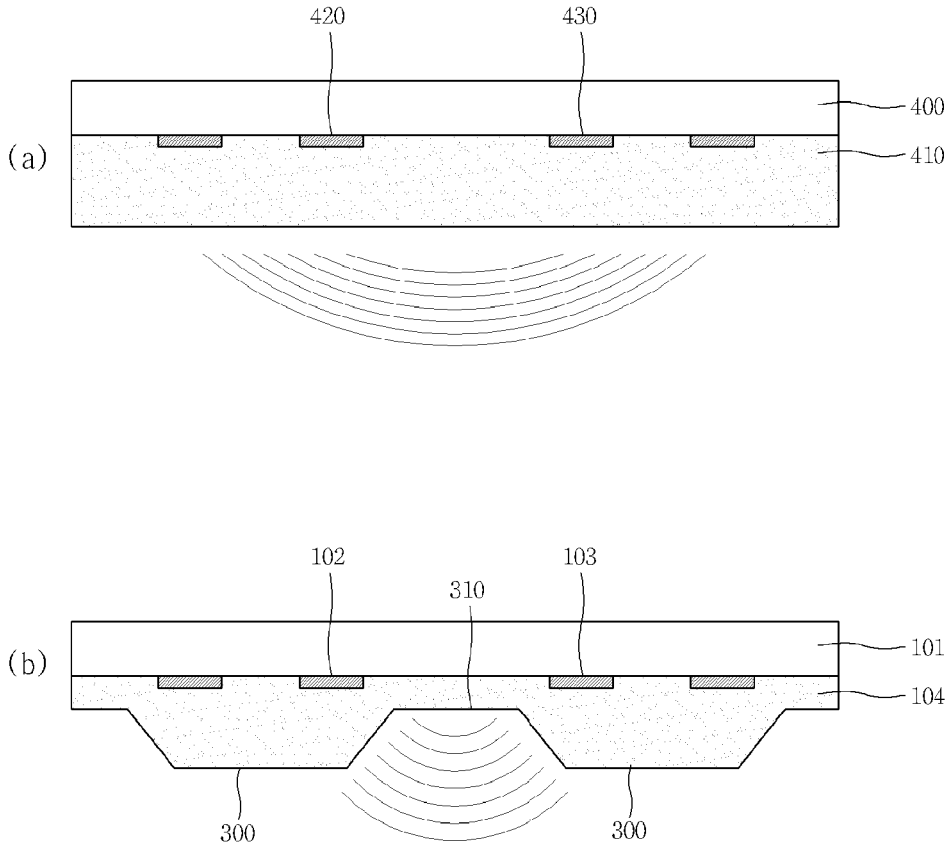
FIG. 4 is a diagram for explaining an example of functions of a convex portion and a concave portion.

Referring to FIG. 4(*a*), a scan electrode 420 and a sustain electrode 430 are arranged on a front substrate 400 and an upper dielectric layer 410 is formed on the front substrate 400 to cover the scan electrode 420 and the sustain electrode 430. The upper dielectric layer 410 does not include a convex portion and a concave portion and has a substantially flat surface.

When a driving signal is supplied to the scan electrode 420 and the sustain electrode 430 to generate discharge, the path of discharge generated between the scan electrode 420 and the sustain electrode 430 lengthens because the scan electrode 420 and the sustain electrode 430 are arranged in parallel on the same layer, and thus a discharge firing voltage can relatively increases and driving efficiency can decrease.

If a gap g1 between the scan electrode 420 and the sustain electrode 430 is relatively wide, a positive column region can be used in the event of discharge so that driving efficiency can be improved. However, the path of discharge generated between the scan electrode 420 and the sustain electrode 430 can further increases to raise the discharge firing voltage and deteriorate the driving efficiency.

FIG. 4(*b*) illustrates that the convex portion 300 and the concave portion 310 are arranged together in the upper dielectric layer 104 as described in the aforementioned embodiment of the present invention. The concave portion 310 is located between the scan electrode 102 and the sustain electrode 103.

When a driving signal is supplied to the scan electrode 102 and the sustain electrode 103 to generate discharge, most wall charges are accumulated in the concave portion 310 placed between the scan electrode 102 and the sustain electrode 103, and thus the path of discharge can became shorter than that in the case of FIG. 4(*a*). Accordingly, the discharge firing voltage between the scan electrode 102 and the sustain electrode 103 decreases so that the driving efficiency can be improved.

In this case, when a gap g between the scan electrode 102 and the sustain electrode 103 becomes relatively wide, the positive column region can be sufficiently used in the event of discharge. This can improve the driving efficiency and prevent the discharge firing voltage between the scan electrode 102 and the sustain electrode 103 from excessively increasing.

In the current embodiment of the present invention, although the gap g between the scan electrode 102 and the sustain electrode 103 is not specially limited, the gap g can be 60 μm or more and, desirably, 80 μm or more in consideration of the fact that driving efficiency can be improved when the gap g between the scan electrode 102 and the sustain electrode 103 is sufficiently wide because the positive column region can be utilized in the event of discharge while the discharge firing voltage between the scan electrode 102 and the sustain electrode 103 can be prevented from excessively increasing.

FIG. 5 is a table for explaining the thickness or the portion of the upper dielectric layer corresponding to the concave portion and the thickness of the portion of the upper dielectric layer corresponding to the convex portion in more detail.

In the case of FIG. 5, the thickness of the portion of the upper dielectric layer corresponding to the convex portion, that is, the maximum thickness t2 of the upper dielectric layer, is fixed to 32 μm and the thickness t1 of the portion of the upper dielectric layer corresponding to the concave portion is varied such that the ratio of the thickness of the portion of the upper dielectric layer corresponding to the concave portion to the thickness of the portion of the upper dielectric layer corresponding to the convex portion is adjusted from 0.03 to 0.98, and the discharge firing voltage between the scan electrode and the sustain electrode, the degree of difficulty in manufacturing the upper dielectric layer, and structural stability of the upper dielectric layer are determined.

In FIG. 5, ◎ represents that the discharge firing voltage between the scan electrode and the sustain electrode is sufficiently low, the degree of difficulty in manufacturing the upper dielectric layer is low or the structural stability of the upper dielectric layer is sufficiently high, ○ represents that the three parameters are relatively satisfactory, and X represents that the three parameters are poor.

Referring to FIG. 5, in terms of the discharge firing voltage between the scan electrode and the sustain electrode, the concave portion has a sufficient depth when the thickness t1 of the portion of the upper dielectric layer corresponding to the concave portion is equal to or more than 0.03 times and equal to or less than 0.7 times of the thickness t2 of the portion of the upper dielectric layer corresponding to the convex portion. Accordingly, a sufficient quantity of wall charges can be accumulated in the concave portion in the event of discharge, and thus the discharge firing voltage between the scan electrode and the sustain electrode can be sufficiently low (◎).

When the thickness t1 of the portion of the upper dielectric layer corresponding to the concave portion is equal to or more than 0.85 times and equal to or less than 0.9 times of the thickness t2 of the portion of the upper dielectric layer corresponding to the convex portion, the concave portion has an appropriate depth, and thus the discharge firing voltage between the scan electrode and the sustain electrode is relatively satisfactory (○).

However, when the thickness t1 of the portion of the upper dielectric layer corresponding to the concave portion is equal to or more than 0.98 times of the thickness t2 of the portion of the upper dielectric layer corresponding to the convex portion, an insufficient quantity of wall charges may be accumulated in the concave portion in the event of discharge because the depth of the concave portion is excessively low. Accordingly, the discharge firing voltage between the scan electrode and the sustain electrode may excessively increase (X).

In terms of the degree of difficulty in manufacturing the upper dielectric layer, when the thickness t1 of the portion of the upper dielectric layer corresponding to the concave portion is equal to or more than 0.03 times of the thickness t2 of the portion of the upper dielectric layer corresponding to the convex portion, the front substrate can be exposed from the upper dielectric layer if manufacturing equipment is slightly misaligned because the thickness t1 of the portion of the upper dielectric layer corresponding to the concave portion is excessively small. Furthermore, a time required to form the concave portion may increase because the concave portion should be formed to a sufficient depth. Accordingly, the degree of difficulty in manufacturing the upper dielectric layer is high (X).

When the thickness t1 of the portion of the upper dielectric layer corresponding to the concave portion is equal to or more than 0.04 times and equal to or less than 0.12 times of the thickness t2 of the portion of the upper dielectric layer corresponding to the convex portion, the thickness t1 of the portion of the upper dielectric layer corresponding to the concave portion is appropriate, and thus the degree of difficulty in manufacturing the upper dielectric layer is relatively satisfactory (○).

When the thickness t1 of the portion of the upper dielectric layer corresponding to the concave portion is equal to or more than 0.15 times of the thickness t2 of the portion of the upper dielectric layer corresponding to the convex portion, the time required to form the concave portion is relatively short because the depth of the concave portion is excessively low. Furthermore, the concave portion can be sufficiently stably formed even if the manufacturing equipment is misaligned to a certain degree because the depth of the concave portion is sufficiently low. Accordingly, the degree of difficulty in manufacturing the upper dielectric layer is very satisfactory (◎).

In terms of the structural stability of the upper dielectric layer, when the thickness t1 of the portion of the upper dielectric layer corresponding to the concave portion is equal to 0.03 times of the thickness t2 of the portion of the upper dielectric layer corresponding to the convex portion, a thickness difference between the convex portion and the concave portion is excessively large because the thickness t1 of the portion of the upper dielectric layer corresponding to the concave portion is excessively small. Accordingly, the possibility of destroying the convex portion increases, and thus the structural stability of the upper dielectric layer is poor (X).

When the thickness t1 of the portion of the upper dielectric layer corresponding to the concave portion is equal to or more than 0.04 times and equal to or less than 0.06 times of the thickness t2 of the portion of the upper dielectric layer corresponding to the convex portion, the thickness t1 of the portion of the upper dielectric layer corresponding to the concave portion is appropriate, and thus the structural stability of the upper dielectric layer is relatively satisfactory (○).

When the thickness t1 of the portion of the upper dielectric layer corresponding to the concave portion is equal to or more than 0.092 times of the thickness t2 of the portion of the upper dielectric layer corresponding to the convex portion, the thickness difference between the concave portion and the convex portion is very small so that the structural stability of the upper dielectric layer is very satisfactory (◎).

In consideration of the data of FIG. 5, the thickness t1 of the portion of the upper dielectric layer corresponding to the concave portion is equal to or more than 0.04 times and equal to or less than 0.9 times of the thickness t2 of the portion of the upper dielectric layer corresponding to the convex portion, preferably, and equal to or more than 0.15 times and equal to or less than 0.7 times of the thickness t2 of the portion of the upper dielectric layer corresponding to the convex portion, more preferably, in order to decrease the discharge firing voltage between the scan electrode and the sustain electrode, reduce the degree of difficulty in manufacturing the upper dielectric layer, and improve the structural stability of the upper dielectric layer.

Under the aforementioned condition, the thickness t1 of the portion of the upper dielectric layer corresponding to the concave portion can be 2 μm or more and 30 μm or less and the thickness t2 of the portion of the upper dielectric layer corresponding to the convex portion can be 20 μm or more and 50 μm or less.

FIG. 6 is a table for explaining the width of the concave portion in more detail. In the case of FIG. 6, the top width W2 of the concave portion is fixed to about 60 μm and the bottom width W1 of the concave portion is varied such that the ratio of the top width W2 of the concave portion to the bottom width W1 thereof is adjusted from 0.01 to 0.95, and the discharge firing voltage between the scan electrode and the sustain electrode and the structural stability of the upper dielectric layer are determined.

In FIG. 6, ◎ represents that the discharge firing voltage between the scan electrode and the sustain electrode is sufficiently low or the structural stability of the upper dielectric layer is sufficiently high, ○ represents that the two parameters are relatively satisfactory, and X represents that the two parameters are poor.

The top width W2 of the concave portion corresponds to the width of the concave portion at the surface of the upper dielectric layer and the bottom width W1 of the concave portion is the width at the point corresponding to (¾)d1 where d1 is the depth of the concave portion.

Referring to FIG. 6, in terms of the structural stability of the upper dielectric layer, when the bottom width W1 of the concave portion is equal to or more than 0.01 times and equal to or less than 0.72 times of the top width W2 of the concave portion, the inclined face of the concave portion can become sufficiently gentle because a difference between the bottom width W1 and the top width W2 of the concave portion is sufficient. Accordingly, the structural stability of the upper dielectric layer is very satisfactory (◎).

When the bottom width W1 of the concave portion is equal to or more than 0.83 times and equal to or less than 0.87 times of the top width W2 of the concave portion, the difference between the bottom width W1 and the top width W2 of the concave portion is appropriate, and thus the structural stability of the upper dielectric layer is relatively satisfactory (○).

When the bottom width W1 of the concave portion is equal to or more than 0.95 times of the top width W2 of the concave portion, the inclined face of the concave portion may be excessively steep because the difference between the bottom width W1 and the top width W2 of the concave portion is very small. Then, the possibility of destroying the convex portion increases, and thus the structural stability of the upper dielectric layer is poor (X).

In terms of the discharge firing voltage between the scan electrode and the sustain electrode, when the bottom width W1 of the concave portion is equal to or more than 0.01 times and equal to or less than 0.019 times of the top width W2 of the concave portion, the inclined face of the concave portion can become excessively gentle because the difference between the bottom width W1 and the top width W2 of the concave portion is excessively large. Then, an insufficient quantity of wall charges are accumulated in the concave portion, and thus the discharge firing voltage may increases (X).

When the bottom width W1 of the concave portion is equal to or more than 0.03 times and equal to or less than 0.12 times of the top width W2 of the concave portion, the difference between the bottom width W1 and the top width W2 of the concave portion is appropriate, and thus the discharge firing voltage is relatively satisfactory (○).

When the bottom width W1 of the concave portion is equal to or more than 0.14 times of the top width W2 of the concave portion, the slope of the inclined face of the concave portion can be sufficiently secured because the difference between the bottom width W1 and the top width W2 of the concave portion is sufficiently large. Then, a sufficient quantity of wall charges can be accumulated in the concave portion in the event of discharge, and thus the discharge firing voltage can be sufficiently reduced. That is, the discharge firing voltage is very satisfactory (◎).

In consideration of the data of FIG. 6, the bottom width W1 of the concave portion is equal to or more than 0.03 times and equal to or less than 0.87 times of the top width W2 of the concave portion, desirably, and equal to or more than 0.14 times and equal to or less than 0.72 times of the top width W2 of the concave portion.

Under the aforementioned condition, the bottom width W1 of the concave portion can be 10 μm or more and 200 μm or less and the top width W2 of the concave portion can be 20 μm or more and 300 μm or less.

FIG. 7 is a table for explaining the shortest distance between the scan electrode or the sustain electrode and the surface of the convex portion.

In the case of FIG. 7, the depth d1 of the concave portion is fixed to 20 μm and the shortest distance d2 between the scan electrode or the sustain electrode and the surface of the convex portion is varied such that the ratio of d2 to d1 is adjusted from 1.05 to 27, and the dielectric breakdown of the scan electrode or the sustain electrode and the efficiency of discharge generated between the scan electrode and the sustain electrode are determined.

In FIG. 7, ◎ represents that the discharge efficiency is sufficiently high or the dielectric breakdown of the scan electrode or the sustain electrode can be sufficiently prevented, ○ represents that the discharge efficiency and the dielectric breakdown are relatively satisfactory, and X represents that the discharge efficiency and the dielectric breakdown are poor.

Referring to FIG. 7, in terms of the dielectric breakdown, the upper dielectric layer on the scan electrode or the sustain electrode can become excessively thin because the shortest distance d2 between the surface of the convex portion and the scan electrode or the sustain electrode is much shorter than the depth d1 of the concave portion when the shortest distance d2 is equal to or more than 1.05 times of the depth d1 of the concave portion. Accordingly, the dielectric breakdown of the scan electrode or the sustain electrode can occur frequently (X).

When the shortest distance d2 between the surface of the convex portion and the scan electrode or the sustain electrode is equal to or more than 1.1 times and equal to or less than 1.28 times of the depth d1 of the concave portion, the shortest distance d2 is appropriate, and thus the dielectric breakdown characteristic is satisfactory (○).

When the shortest distance d2 between the surface of the convex portion and the scan electrode or the sustain electrode is equal to or more than 1.32 times of the depth d1 of the concave portion, the shortest distance d2 is sufficient compared to the depth d1 of the concave portion. Accordingly, the portion of the upper dielectric layer, placed on the scan electrode or the sustain electrode, can be sufficiently thick, and thus the dielectric breakdown of the scan electrode or the sustain electrode can be sufficiently prevented (◎).

In terms of driving efficiency, when the shortest distance d2 between the surface of the convex portion and the scan electrode or the sustain electrode is equal to or more than 1.05 times and equal to or less than 5.3 times of the depth d1 of the concave portion, wall charges can be accumulated in the discharge cells according to a driving signal supplied to the scan electrode or the sustain electrode within a short period time and a sufficiently quantity of wall charges can be accumulated in the discharge cells even with a relatively low voltage because the shortest distance d2 is much smaller than the depth d1 of the concave portion. Accordingly, the driving efficiency is vary satisfactory (◎).

When the shortest distance d2 between the surface of the convex portion and the scan electrode or the sustain electrode is equal to or more than 6.7 times and equal to or less than 24 times of the depth d1 of the concave portion, the shortest distance d2 is appropriate, and thus the driving efficiency is relatively satisfactory (○).

When the shortest distance d2 between the surface of the convex portion and the scan electrode or the sustain electrode is equal to or more than 27 times of the depth d1 of the concave portion, the shortest distance d2 is excessively greater than the depth d1 of the concave portion. Accordingly, a time required for wall charges to be accumulated in the discharge cells according to the driving signal supplied to the scan electrode or the sustain electrode can become relatively long. Furthermore, the wall charges can be accumulated in the discharge cells only when the voltage of the driving signal is further increased. This results in poor driving efficiency (X).

In consideration of the data of FIG. 7, the shortest distance d2 between the surface of the convex portion and the scan electrode or the sustain electrode is equal to or more than 1.1 times and equal to or less than 24 times of the depth d1 of the concave portion, desirably, and equal to or more than 1.32 times and equal to or less than 5.3 times of the depth d1 of the concave portion, more desirably.

Under the aforementioned condition, the shortest distance d2 between the surface of the convex portion and the scan electrode or the sustain electrode can be 18 μm or more and 48 μm or less and the depth d1 of the concave portion can be 2 μm or more and 30 μm or less.

Figures 8, 9:
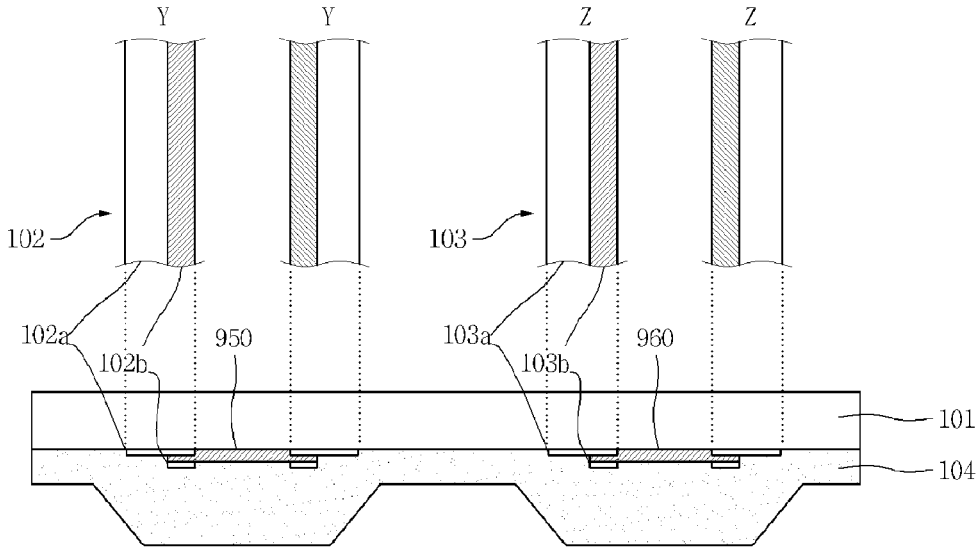
FIG. 8 is a table for explaining the angle of an inclined face of the concave portion.
FIG. 9 is a diagram for explaining an example of the arrangement of scan electrodes and a sustain electrodes.

FIG. 8 is a table for explaining the angle θ of the inclined face of the concave portion. In the case of FIG. 8, the top width T of the convex portion is fixed to a predetermined size, the angle θ of the inclined face of the concave portion is adjusted from 2° to 90° and the discharge firing voltage between the scan electrode and the sustain electrode and the structural stability of the upper dielectric layer are determined.

In FIG. 8, ◎ represents that the discharge firing voltage between the scan electrode and the sustain electrode is sufficiently low or the structural stability of the upper dielectric layer is sufficiently high, ○ represents that the discharge firing voltage and the structural stability are relatively satisfactory, and X represents that the discharge firing voltage is high and the structural stability is poor.

The angle θ of the inclined face of the concave portion is measured on the basis of the top face of the convex portion.

Referring to FIG. 8, in terms of the discharge firing voltage between the scan electrode and the sustain electrode, when the angle of the inclined face of the concave portion based on the top face of the convex portion is 2° or more and 7° or less, the quantity of wall charges accumulated in the concave portion in the event of discharge may insufficient because the angle of the inclined face of the concave portion is excessively gentle, and thus the discharge firing voltage between the scan electrode and the sustain electrode is high, which is not satisfactory (X).

When the angle of the inclined face of the concave portion based on the top face of the convex portion is 10°, the discharge firing voltage between the scan electrode and the sustain electrode is satisfactory (○) because the angle of the inclined face of the concave portion is appropriate.

When the angle of the inclined face of the concave portion based on the top face of the convex portion is 15° or more, a sufficient quantity of wall charges can be accumulated in the concave portion in the event of discharge because the angle of the inclined face of the concave portion is sufficiently secured. Accordingly, the discharge firing voltage between the scan electrode and the sustain electrode is vary satisfactory (◎).

In terms of the structural stability of the upper dielectric layer, when the angle of the inclined face of the concave portion based on the top face of the convex portion is 2° or more and 60° or less, sufficient structural stability of the upper dielectric layer covering the scan electrode and the sustain electrode can be secured (◎) because the angle of the inclined face of the concave portion is sufficiently gentle.

When the angle of the inclined face of the concave portion based on the top face of the convex portion is 70° or more and 80° or less, the structural stability of the upper dielectric layer is satisfactory (○) because the angle of the inclined face of the concave portion is appropriate.

When the angle of the inclined face of the concave portion based on the top face of the convex portion is 90° or more, the angle of the inclined face of the concave portion is excessively steep, and thus the possibility of destroying the convex portion can increase. Accordingly, the structural stability of the upper dielectric layer is low (X).

In consideration of the data of FIG. 8, the angle of the inclined face of the concave portion based on the top face of the convex portion is 10° or more and 80° or less, desirably, and 15° or more and 60° or less, more desirably.

FIG. 9 is a diagram for explaining the arrangement of scan electrodes and sustain electrodes. Referring to FIG. 9, two scan electrodes 102 are continuously arranged and two sustain electrodes 103 are continuously arranged.

A first black layer 950 can be commonly located between transparent electrodes 102*a* and bus electrodes 102*b* of the two continuously arranged scan electrodes 102 and a second black layer 960 can be commonly placed between transparent electrodes 103*a* and bus electrodes 103*b* of the two continuously arranged sustain electrodes 103. The first black layer 950 and the second black layer 960 can prevent the generation of reflective light according to the bus electrodes 102*b* and 103*b* and cover a barrier rib (not shown) so as to improve contrast characteristic.

When the scan electrodes 102 and the sustain electrodes 103 are arranged in the order of a scan electrode 102, a scan electrode 102, a sustain electrode 103 and a sustain electrode 103, coupling between neighbouring two electrodes can be reduced so as to decrease noise and electromagnetic interference (EMI). In addition, the two scan electrodes 102 or the two sustain electrodes 103 can be overlapped with a single concave portion 300.

When the single convex portion 300 is overlapped with the two scan electrodes 102 or the two sustain electrodes 103, the number of concave portions 300 can be reduced as compared to the case where a single concave portion is formed for each scan electrode 102 or each sustain electrode 103. This can simplify a manufacturing process and decrease the manufacturing cost.

Although FIG. 9 illustrates that each scan electrode 102 and each sustain electrode 103 respectively include the transparent electrodes 102*a* and 103*a* and the bus electrodes 102*b* and 103*b*, the transparent electrodes 102*a* and 103*a* can be omitted.

Figure 10:
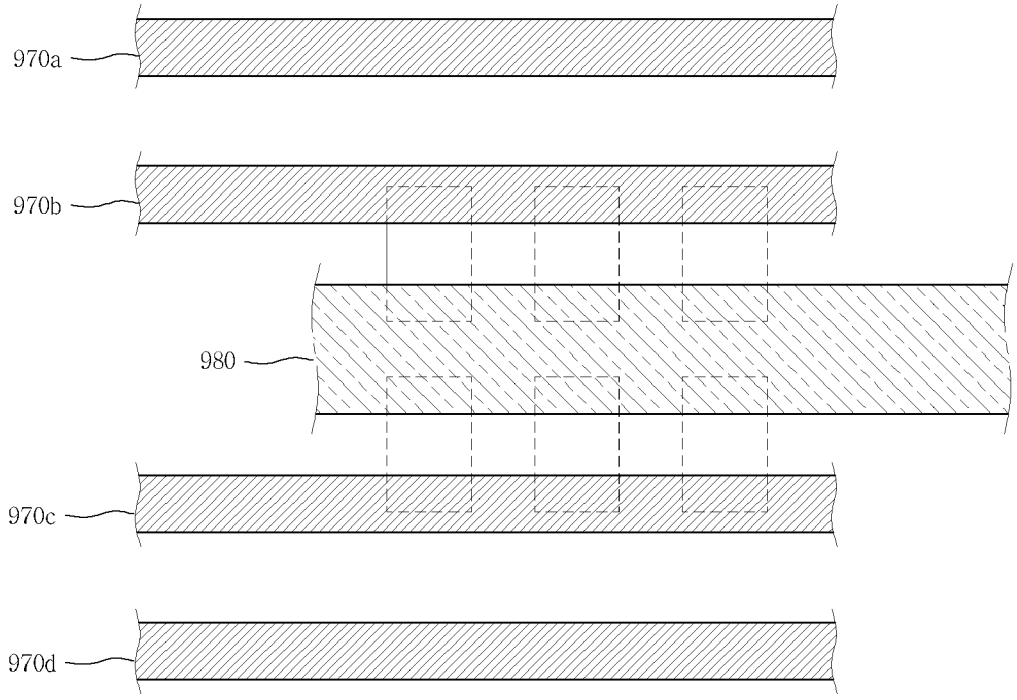
FIG. 10 is a diagram for explaining another example of the arrangement of scan electrodes and sustain electrodes.

FIG. 10 is a diagram for explaining another example of the arrangement of a scan electrode and a sustain electrode. Referring to FIG. 10, scan electrodes 970*a*, 907*b*, 970*c* and 970*d* and a sustain electrode 980 can be arranged in the order of a scan electrode, a scan electrode, a sustain electrode, a scan electrode and a scan electrode. For example, the scan electrodes 970*a*, 907*b*, 970*c* and 970*d* and the sustain electrode 980 can be arranged in the order of the first scan electrode 970*a*, the second scan electrode 970*b*, the sustain electrode 980, the third scan electrode 970*c* and the fourth electrode 970*d*.

In comparison of the case of FIG. 10 with the case of FIG. 9, it can be considered that the continuously arranged two sustain electrodes in the case of FIG. 9 are integrated into one in the case of FIG. 10.

In FIG. 10, an example of discharge cells defined by a barrier rib is represented as dotted lines.

As described above, the manufacturing process can be simplified and the manufacturing cost can be reduced when continuously arranged two sustain electrodes are integrated into one.

Figure 11:
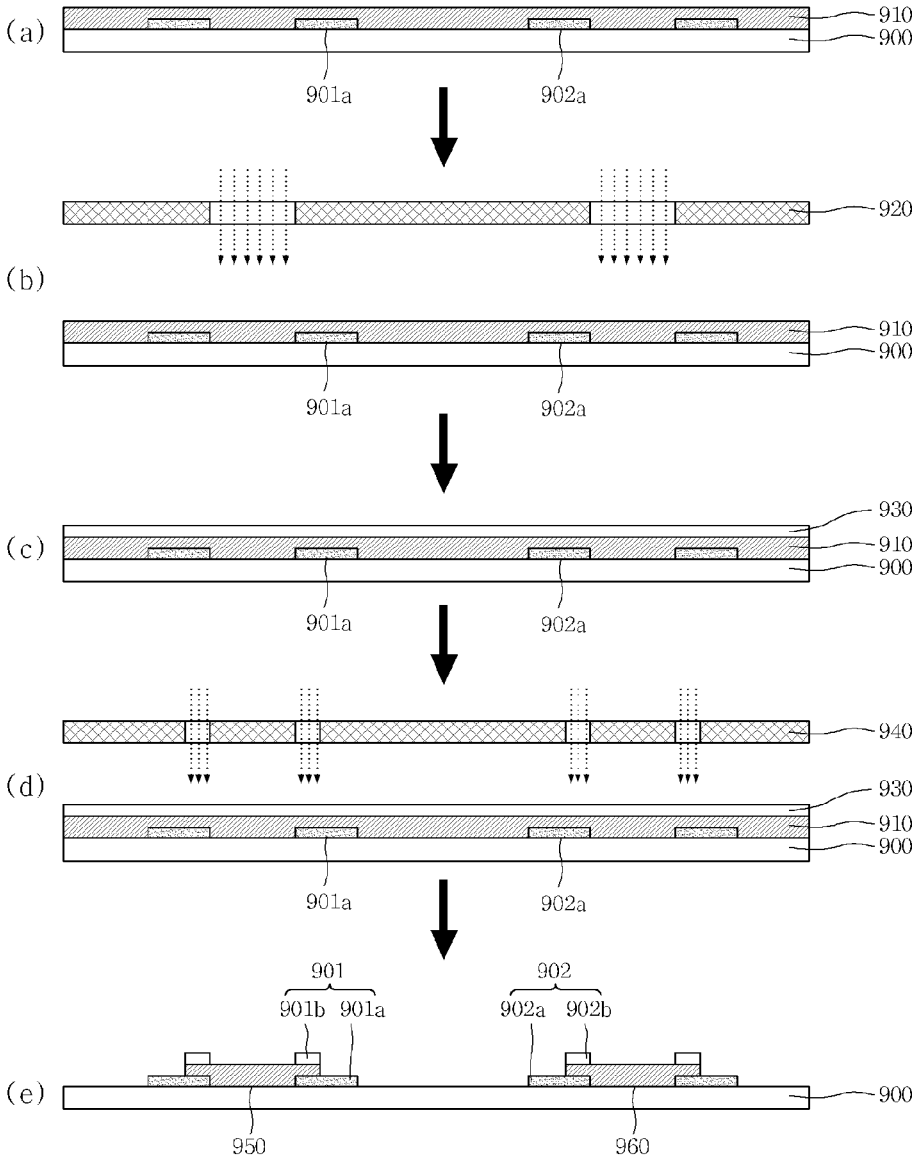
FIG. 11 illustrates a method of manufacturing a scan electrode and a sustain electrode according to an embodiment of the present invention.

FIG. 11 illustrates a method of manufacturing a scan electrode and a sustain electrode according to an embodiment of the present invention. Referring to FIG. 11(*a*), transparent electrodes 901*a* and 902*a* are formed on a front substrate 900 and a black material layer 910 is formed on the front substrate 900 including the transparent electrodes 901*a* and 902*a*.

Referring to FIG. 11(*b*), a first photo mask 920 having a predetermined pattern is arranged above the black material layer 910 and the black material layer 910 is exposed using the pattern formed in the first photo mask 920.

Referring to FIG. 11(*c*), an electrode material layer 930 is formed on the exposed black material layer 910. Here, the electrode material layer 930 for forming bus electrodes 901*b* and 902*b* can be made of a material with high electrical conductivity, such as Au, Ag, Cu, Al and the like.

Referring to FIG. 11(*d*), a second photo mask 940 having a predetermined pattern is arranged above the electrode material layer 930 and the electrode material layer 930 is exposed according to the pattern of the second photo mask 940. Subsequently, the exposed black material layer and electrode material layer 930 are developed together.

Then, a scan electrode 901 and a sustain electrode 902 having the structure described with reference to FIG. 9 can be formed, as illustrated in FIG. 11(*e*).

In the above-described method of manufacturing the scan electrode 901 and the sustain electrode 902, first and second black layers 950 and 960 and the bus electrodes 901*b* and 902*b* can be formed together through a one-time development process, and thus a time required for the manufacturing process can be reduced and the manufacturing cost can be also decreased.

A dielectric material layer (not shown) can be formed on the front substrate 900 on which the scan electrode 901 and the sustain electrode 902 are formed after the scan electrode 901 and the sustain electrode 902 are formed. Here, portions of the top of an upper dielectric layer (not shown) can be recessed or protruded according to the shapes of the scan electrode 901 and the sustain electrode 902 by controlling the viscosity of the dielectric material layer (not shown).

After the dielectric material layer (not shown) is formed, the dielectric material layer (not shown) is dried or burnt to form a concave portion and a convex portion in the upper dielectric layer.

Furthermore, it is possible to recess predetermined portions of the upper dielectric layer using a blade having a predetermined shape to form the concave portion and the convex portion in the upper dielectric layer after the dielectric material layer is formed. Otherwise, it is also possible to etch the predetermined portions of the upper dielectric layer using a developer to form the concave portion and the convex portion in the upper dielectric layer.

Figure 12:
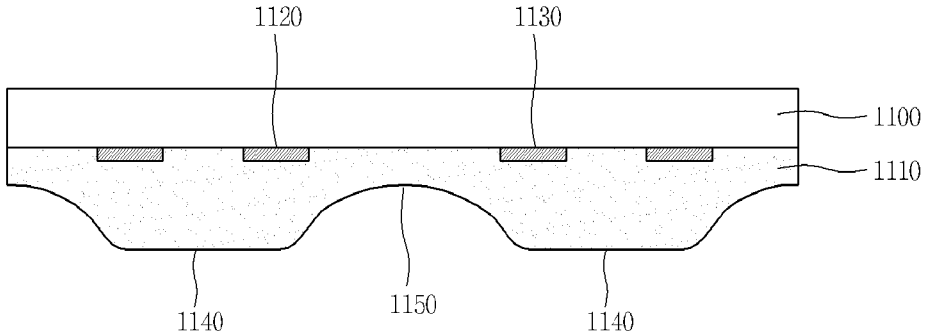
FIGS. 12 and 13 illustrate various shapes of the concave portion.
Figure 13:
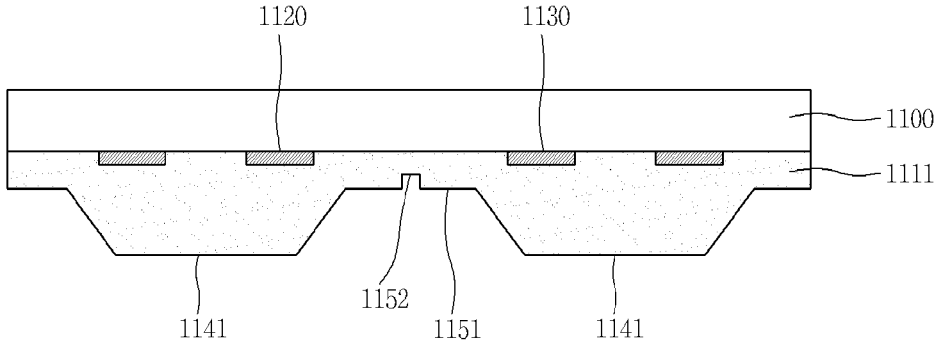

FIGS. 12 and 13 are diagrams for explaining an example of concave portions having different shapes. In FIGS. 12 and 13, explanations of components other than the concave portions are omitted.

Referring to FIG. 12, a concave portion 1150 can have curvature. For example, the cross section of the concave portion 1150 can be oval.

When the concave portion 1150 has curvature, wall charges are prevented from concentrating on a specific portion in the event of discharge, and thus discharge can be stabilized.

Referring to FIG. 13, another concave portion 1152 can be formed under a concave portion 1151. The concave portion 1152 can be formed using a blade having a predetermined shape.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A plasma display panel comprising:

a front substrate;

a plurality of electrodes arranged on the front substrate;

an upper dielectric layer coveting the plurality of electrodes on the front substrate; and a rear substrate arranged opposite to the front substrate, wherein the upper dielectric layer comprises a convex portion thicker than a surrounding portion thereof and a concave portion thinner than a surrounding portion thereof, and a middle portion positioned between the convex portion and the concave portion, wherein the convex and concave portions have uniform thickness, wherein a thickness of the middle portion gradually increases from the concave portion to the convex portion, wherein the electrodes includes a scan electrode and a sustain electrode, wherein the scan electrodes and the sustain electrodes are arranged in the order of the scan electrode, the scan electrode, the sustain electrode and the sustain electrode, wherein the concave portion is located between the scan electrode and the sustain electrode, wherein the middle portion is partially overlapped with the scan electrode or the sustain electrode in a vertical direction with respect to the front substrate, wherein two scan electrodes or the two sustain electrodes are partially overlapped with the single convex portion in the vertical direction, and wherein the concave portion is not overlapped with the scan electrode and the sustain electrode.

2. The plasma display panel of claim 1, wherein the thickness of the portion of the upper dielectric layer corresponding to the concave portion is equal to or more than 0.04 times and equal to or less than 0.9 times of the thickness of the portion of the upper dielectric layer corresponding to the convex portion.

3. The plasma display panel of claim 1, wherein a distance between two tops of neighboring two convex portions is wider than a distance between the scan electrode and the sustain electrode.

4. The plasma display panel of claim 1, wherein a bottom width of the concave portion is equal to or more than 0.03 times and equal to or less than 0.87 times of a top width of the concave portion.

5. The plasma display panel of claim 4, wherein the bottom width of the concave portion is equal to or more than 0.14 times and equal to or less than 0.72 times of the top width of the concave portion.

6. The plasma display panel of claim 1, wherein a shortest distance between a surface of the convex portion and the electrodes is equal to or more than 1.1 times and equal to or less than 24 times of a depth of the concave portion.

7. The plasma display panel of claim 6, wherein the shortest distance between the surface of the convex portion and the electrodes is equal to or more than 1.32 times and equal to or less than 5.3 times of the depth of the concave portion.

8. The plasma display panel of claim 1, wherein an inclined angle of the middle portion is equal to or more than 10° and equal to or less than 80°.

9. The plasma display panel of claim 8, wherein the included angle of the middle portion is equal to or more than 15° and equal to or less than 60°.

* * * * *